US006723182B1

(12) United States Patent
Bahmiller

(10) Patent No.: US 6,723,182 B1
(45) Date of Patent: Apr. 20, 2004

(54) MARTENSITIC ALLOY STEELS HAVING INTERMETALLIC COMPOUNDS AND PRECIPITATES AS A SUBSTITUTE FOR COBALT

(76) Inventor: Arthur J. Bahmiller, 1036 Northford Ct., Medina, OH (US) 44256

( * ) Notice: Subject to any disclaimer, the term of this patent is extended or adjusted under 35 U.S.C. 154(b) by 38 days.

(21) Appl. No.: 10/294,304

(22) Filed: Nov. 14, 2002

(51) Int. Cl.[7] ..... C22C 38/24; C22C 38/22; C22C 38/30; C22C 38/46; C22C 38/44

(52) U.S. Cl. ..... 148/326; 148/328; 148/334; 148/335; 148/325; 148/321; 148/324

(58) Field of Search ..... 148/307, 545, 148/607, 621, 325, 326, 328, 333, 334, 335, 542, 548, 611, 622, 321, 324; 426/37, 63, 69

(56) References Cited

U.S. PATENT DOCUMENTS 3,850,621 A 11/1974 Haberling et al. ..... 420/10
4,116,685 A * 9/1978 Okuno ..... 420/102
4,842,818 A * 6/1989 Kato et al. ..... 420/100
5,009,843 A * 4/1991 Sugimoto et al. ..... 420/112
5,106,577 A * 4/1992 Fesler ..... 420/12
5,160,553 A * 11/1992 Leban et al. ..... 148/318
5,169,459 A * 12/1992 Fukushima et al. ..... 148/325
5,454,883 A * 10/1995 Yoshie et al. ..... 148/320
5,651,842 A * 7/1997 Nakamura et al. ..... 148/321
5,749,140 A * 5/1998 Polito et al. ..... 29/527.1
6,096,262 A * 8/2000 Ueta et al. ..... 420/67
6,200,528 B1 3/2001 Rodney et al. ..... 420/110

OTHER PUBLICATIONS

M. Murayama, Y. Katayama and K. Hono, "Microstructural Evolution in a 17–4 PH Stainless Steel after Aging at 400° C.", Metallurgical and Materials Transactions A, vol. 30A, Feb. 1999, pp. 345–353.

A.M. Bayer, B.A. Becherer, "Aluminum Modified High Speed Steels", Proceedings at High Speed Steel Conference, Leoben, Austria, 1990, pp. 144–151.

Crucible Tool Steel and Specialty Alloy Selector, published 1999, pp. 290–291.

George A. Roberts and Robert A. Cary, "Tool Steels", 4th edition, 1980, p. 660.

* cited by examiner

*Primary Examiner*—Deborah Yee
(74) *Attorney, Agent, or Firm*—Pearne & Gordon LLP

(57) ABSTRACT

A cobalt-free martensitic steel exhibiting good response to hardening and resistance to softening at high temperatures, the steel containing sub-micron and nano-structural precipitates and intermetallic compounds of silicon, nickel, aluminum, copper and manganese.

10 Claims, 1 Drawing Sheet

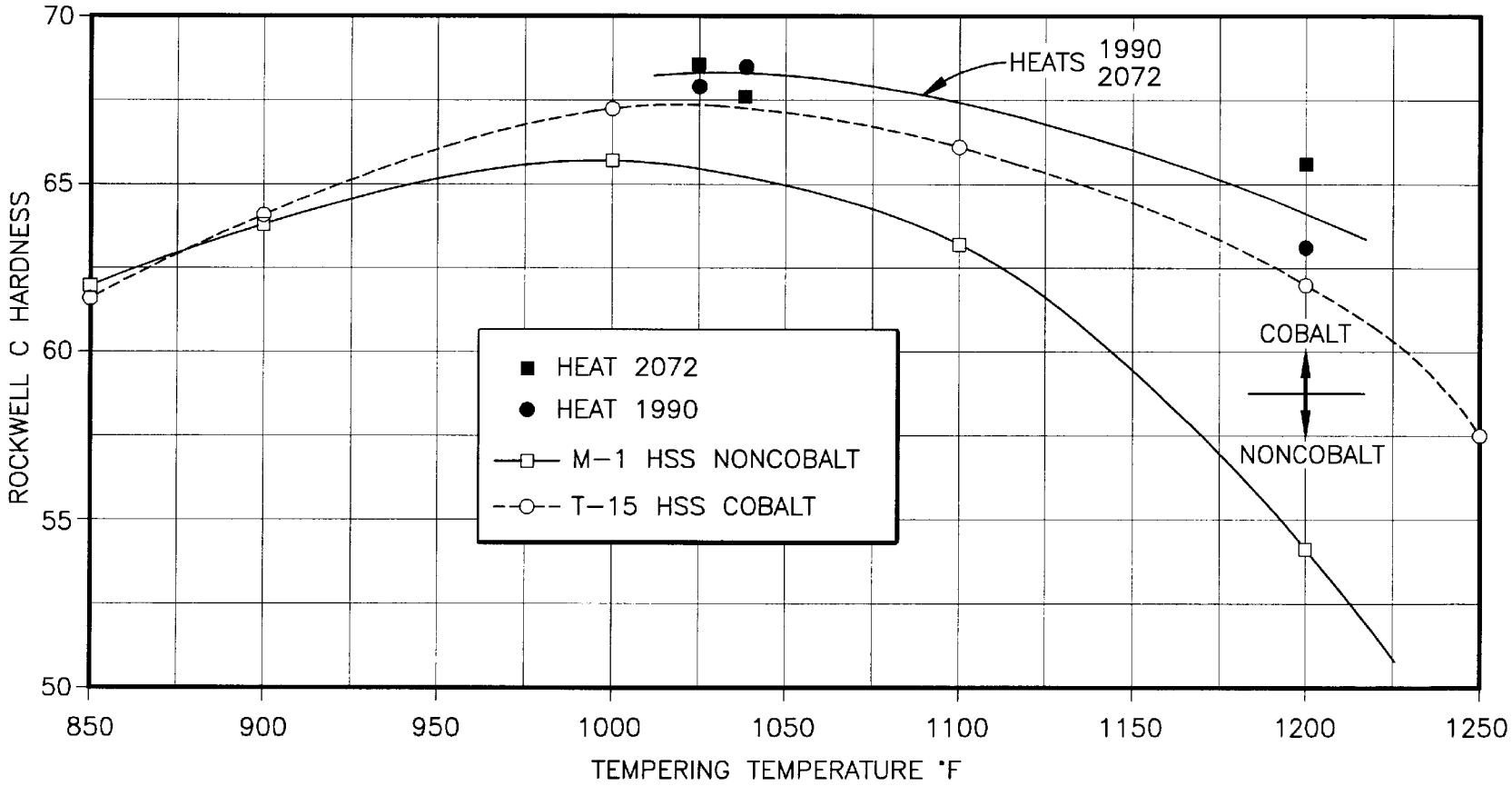
HEATS 1990 2072
COBALT
NONCOBALT
HEAT 2072
HEAT 1990
M-1 HSS NONCOBALT
T-15 HSS COBALT
ROCKWELL C HARDNESS
70
65
60
55
50
850
900
950
1000
1050
1100
1150
1200
1250
TEMPERING TEMPERATURE °F

MARTENSITIC ALLOY STEELS HAVING INTERMETALLIC COMPOUNDS AND PRECIPITATES AS A SUBSTITUTE FOR COBALT

FIELD OF THE INVENTION

The present invention relates generally to alloy steels, and, more specifically, to martensitic steel alloy compositions intended for use as high speed tool steels, hot work and cold work die steels, armor plate, and other applications requiring good response to hardening, resistance to softening at high work temperatures, and high yield strength, the alloy composition being characterized by the presence of intermetallic compounds and precipitates that are substituted for cobalt.

BACKGROUND OF THE INVENTION

A conventional approach to obtaining the hot hardness properties required of alloy steels useful for applications as described above has been to use cobalt as an alloying element. Cobalt is an expensive, strategic material that must be imported. In some applications, such as high speed tools, alloying amounts of cobalt are thought by some to have detrimental health effects. Cobalt additions in heat resisting steel compositions also have certain negative effects, such as reduction of material toughness. Because of these considerations, various attempts have been made to eliminate cobalt by substituting alloy systems based on carbide forming elements, such as niobium, titanium, chromium, tungsten, molybdenum and the like. A study was also made of the possibility of using silicon and aluminum additions totaling about 2.5% in order to replace or substantially reduce cobalt in high speed tool steels. One reason that none of these expedients have been commercially accepted is believed to be the inability to consistently achieve the desired hardness and strength properties and/or irregular results.,

SUMMARY OF THE INVENTION

The purpose of the present invention is to eliminate or significantly reduce cobalt in heat resisting steels, such,as high speed tool steels (HSS), die work steels, armor plate and the like, without sacrificing, and in many instances improving the properties expected of cobalt systems, particularly response to hardening and resistance to softening at elevated temperatures.

In general, the purpose of the invention is accomplished by substituting for cobalt sub-micron and nano-structural precipitates and intermetallic compounds including $M_3Si$. The formation of these precipitates and compounds is promoted by the addition of each of nickel, copper, aluminum, manganese and silicon in a total amount of at least 4.0% by weight with an optimum minimum amount being 4.5%. The silicon content exceeds 1.0%. The addition of these elements improves material response to hardening, resistance to softening at elevated temperatures and yield strength in all martensitic grade steels at very low cost in comparison to cobalt alloyed steels. The resistance to softening at elevated work temperatures is so significant that it may exceed that of super cobalt alloyed HSS materials.

"As used in the following disclosure and in the appended claims, all indicated percentages are to be understood to mean percentages by weight."

One embodiment of the invention is a martensitic alloy steel consisting essentially of about 0.15–3.5% C, 0.5–13.0% Cr, 0.05–15.0% V, 0.75–12.0% Mo, 0–15.0% W, a residual amount of Co less than 1.25%, more preferably, 0.5% or less, each of Ni, Cu, Al, Mn and Si in a total amount of at least 4.0% with the silicon content exceeding 1.0%, and the balance essentially iron.

A more specific embodiment of an HSS material within the scope of the invention having the desired properties of good hardening response, resistance to softening at elevated work temperatures and good yield strength is a martensitic alloy consisting essentially of about 0.15–1.15% C, 3.5–4.5% Cr, 1.0–1.6% V, 8.5–10.0% Mo, 1.4–2.10% W, less than 1.5% Co, each of Ni, Cu, Al, Mn and Si in a total amount of at least 4.0% with the silicon content exceeding 1.0%, and the balance essentially iron.

Still another example of the invention is an alloy system useful for armor plate including 0.15–0.35% C, 0.60–1.00% Mn, 0.40–0.90% Cu, 7.0–10.0% Ni, 0.50–1.00% Al, 1.0–1.50% Si, 0.05–0.25% V, 0.50–1.25% Cr, and 0.75–1.25% Mo.

Examples of hot work and cold work die steels contain 0.30–3.5C, 3.50–13.0% Cr, 2.75–15.0% V, 0.75–2.00% Mo, 5.75–6.75% W, less than 1.25%, and more preferably less than 1.0% Co, 0.70–1.20% Ni, 1.0–1.75% Si, 0.50–1.50% Al, 0.40–0.90% Cu, 0.60–1.00% Mn, and the balance essentially iron.

In carrying out the invention, a steel according to any of the previous paragraphs is austenitized in the range of from 1750–2250° F., rapid quenched to room temperature, and multiple tempered to a range of from 900–1050° F.

Other features, advantages, examples and a fuller understanding of the invention will be had from the following detailed description and accompanying drawing.

DESCRIPTION OF THE DRAWING

The drawing is a graph showing hardness versus tempering temperature of a non-cobalt containing high speed steel, a typical cobalt containing high speed steel, and two high speed tool examples according to the present invention.

DESCRIPTION OF THE PREFERRED EMBODIMENTS

As generally described above, this invention resides in the concept of forming sub-micron and nano-structural precipitates and intermetallic compounds in martensitic heat resistant steels, such as HSS, die steels, armor plate and other heat resistant steel applications. These precipitates and compounds make it unnecessary to add cobalt in order to achieve properties such as good response to hardening and resistance to softening at elevated temperatures. Additionally, the intermetallic compounds and precipitates improve the yield strength of heat resistant steels compared to cobalt containing compositions.

The sub-micron and nano-size precipitates and intermetallic compounds are produced by increasing the amounts of the nickel, silicon, aluminum, manganese and copper commonly present as residuals in many martensitic steels. In the steel compositions of this invention, each of these strengthening elements are present in a combined or total amount of at least 4.0%. The optimum minimum amount of the five elements is 4.5%. In all compositions, the silicon content exceeds 1.0% in order to promote the formation of $M_3Si$ nano-size compounds upon heat treatment. The formation and precipitation of the sub-micron and nano-size compounds and precipitates strengthen the martensitic base of heat resistant steels to a level equal or superior to that produced by 5 to 10% cobalt additions.

HSS and other heat resistant steels are commonly produced by either the electric arc furnace air melt method, generally used for lower vanadium cobalt grades, or the powder method which is used for the high vanadium cobalt grades. The steels of this invention can be made by both melting practices.

In the compositions of this invention, nickel is present in an amount of at least 0.70% and silicon exceeds 1.0%. When nickel and silicon are above the respective threshold levels of 0.70% and 1.0%, it is believed that the strong affinity for each other forms the nano-size intermetallic compound $M_3Si$ upon heat treatment. $M_3Si$ is believed to be the most effective contributor to increased secondary hardness and resistance to softening at the high work temperatures of HSS.

Manganese is always present in HSS and other heat resistant steels, but is normally in the range of 0.20–0.35% compared to a desired minimum of about 0.60% in preferred compositions of this invention. The preferred higher level of manganese is such that it enters into formation of the intermetallic compounds $M_3$ Si and $M_3$ Al in amounts sufficient to increase hardness, yield strength and resistance to high temperature softening.

Aluminum also is an element commonly present in HSS as a residual. Some studies in past have investigated the effect of making a 1.0% aluminum addition to M-2 HSS, but the usual range, although rarely checked, has been about 0.10–0.20%. For purposes of the present invention, aluminum is added in amounts up to about 1.5%. A minor portion of the aluminum addition results in aluminum rich hexagonal crystal precipitate, the size of which is mostly less than one micron in diameter, but may range up to two microns or larger. The composition of these particles has been found to be approximately 90% aluminum along with about 10% iron, tungsten and molybdenum. The major portion of the aluminum addition is present in the nano-structure of $M_3$ Al intermetallic compound along with the iron, nickel and manganese group. The nano-size $M_3$ Al compound has a positive effect on hardness, yield strength and resistance to softening, although to a lesser degree than the $M_3$ Si.

Copper is typically present as a residual in HSS and other heat resistant martensitic alloy steels, and may range from about 0.10–0.20%. According to the present invention, the copper content ranges from about 0.40–0.90%. Since copper is insoluble in iron, it is all in solution upon austenitizing and is retained on quenching in the martensite. On tempering, it is the first element to precipitate out and combines with the nickel, silicon and aluminum as alloy. It is believed that copper alloyed particles are present in the nano-structural condition with a total volume in the range of 1.0–1.5% so as to contribute to the desired properties of increased strength and resistance to heat softening. Another advantage of the desired copper addition is that copper, along with aluminum, contributes to an increase in the heat conductivity of HSS material so as to improve heat transfer from the interface in cutting tool applications. It is also believed that the copper precipitates enhance the formation of the $M_3$ Si intermetallic compounds so as to improve the diffusion rate.

In summary of the foregoing, the various systems which make it possible to eliminate cobalt without sacrificing heat resistance to softening and response to hardening include the following:

(1) the formation of $M_3$ Si, i.e. $(Ni\ Fe\ Mn)_3$ Si, during tempering. These compounds are retained in solution in nano-structural condition and are the major contributor to high hardness response and resistance to high heat softening.

(2) the formation of $M_3$ Al, i.e. $(Mn\ Fe\ Ni)_3$ Al, during tempering. These compounds also are retained in solution in nano-structural condition.

(3) the precipitation of copper rich alloy particles during tempering in nano-structural size.

As shown, by following examples, good results are obtained by hardening or austenitizing in a range of from 1750–2250° F., rapid quenching in salt or oil to room temperature, and then tempering to a range of 900–1050° F. Multiple type tempering is preferred for most compositions.

EXAMPLES

In general, all HSS exhibit a typical, similarly shaped tempering curve when hardened at normal or optimal hardening temperatures for good cutting tool performance. The accompanying drawing shows tempering curves for an AISI M-1 which is a non-cobalt HSS, an AISI T-15 which is a cobalt HSS, and two HSS heats (1990 and 2072) prepared according to this invention. The compositions of the two steels of the invention are set out in Table 1.

TABLE 1

| | Heat 1990 | Heat 2072 |
|---|---|---|
| Carbon | 1.12 | 1.14 |
| Nickel | 0.99 | 0.98 |
| Manganese | 0.78 | 0.75 |
| Silicon | 1.20 | 1.47 |
| Aluminum | 1.05 | 1.52 |
| Copper | 1.00 | 0.54 |
| Phosphorus | 0.041 | 0.03 |
| Sulfur | <0.008 | <0.009 |
| Chromium | 3.95 | 4.15 |
| Vanadium | 1.14 | 1.45 |
| Tungsten | 2.02 | 1.91 |
| Molybdenum | 9.89 | 9.74 |
| Cobalt | 1.24 | 0.51 |

With HSS materials, a maximum hardness is realized by double or, optionally, triple tempering in the general range of 1000°–1050° F. which is the optimal temperature for good cutting tool performance. At this temperature, a cobalt addition of 5–10% (T-15) contributes to an increase of about one to two $R_c$ hardness points over M-1. The steels of this invention are shown to exceed the $R_c$ hardness of the cobalt steel T-15 by about one to two $R_c$ points and the non-cobalt steel M-1 by 2.5 to 3 $R_c$ points.

A recognized criterion for evaluating the resistance to softening of HSS is the $R_c$ hardness after tempering for two hours at 1200° F. Heat 2072 tempered in this way had an average $R_c$ hardnesses of 65.4 and heat 1990 had an average $R_c$ hardness of about 62.6. When tempered at 1025° F. and 1040° F., heat 2072 had hardnesses of 68.1 $R_c$ and 67.3 $R_c$, respectively. At the same temperatures, heat 1990 had average hardnesses of about 68.1 $R_c$, respectively. By way of comparison, M-42 and T-15, which are cobalt steels, had hardnesses of 61 and 62 after tempering, while non-cobalt steels M-1, M-10 and M-7 showed $R_c$ hardnesses of about 55 after tempering. Another non-cobalt steel M-2 had a $R_c$ hardness of 56 after tempering. This data shows that the HSS steel of this invention has a very strong resistance to softening similar to or exceeding that of cobalt HSS.

The following Table 2 presents a summary of tempered $R_c$ hardness results for heat 2072 when hardened at 2170° F. and 2190° F. Table 3 shows tempered $R_c$ hardnesses results for heat 1990 when hardened at 2170° F. and 2190° F.

TABLE 2

| | Heat 2072 | | | | |
|---|---|---|---|---|---|
| | 2170° F. | | | 2190° F. | |
| Triple Tempered at: | $R_c$ | | Average | $R_c$ | | Average |
| 1025° F. | 68.0 | 68.0 | 68.0 | 67.5 | 68.0 | 68.0 |
| | 68.5 | 68.0 | | 68.0 | 68.0 | |

TABLE 2-continued

| | Heat 2072 | | | |
|---|---|---|---|---|
| | 2170° F. | | 2190° F. | |
| Triple Tempered at: | $R_c$ | Average | $R_c$ | Average |
| 1040° F. | 67.5 67.5 | 67.5 | 67.0 67.5 | 67.5 |
| 1200° F. | 65.5 65.5 | 65.5 | 65.5 65.5 | 65.5 |
| (single temper 2 hours) | 64.5 65.5 | | 65.0 65.3 | |

TABLE 3

| | Heat 1990 | | | |
|---|---|---|---|---|
| | 2170° F. | | 2190° F. | |
| Triple Tempered at: | $R_c$ | Average | $R_c$ | Average |
| 1025° F. | 67.5<br>67.5 | 67.5 | 68.0<br>67.5 | 68.0 |
| 1040° F. | | | 68.0<br>68.0 | 68.0 |
| 1200° F.<br>(single tempered 2 hours) | 62.5 | | | |

Another heat 9290 having an M-3 base composition excluding cobalt, but including the special elements characterizing the invention, was made by the powder metallurgy method. The composition of heat 9290 is set out in Table 4.

TABLE 4

| | |
|---|---|
| Carbon | 1.40 |
| Nickel | 0.95 |
| Manganese | 0.90 |
| Silicon | 1.26 |
| Aluminum | 1.13 |
| Copper | 0.57 |
| Phosphorus | 0.011 |
| Sulfur | 0.008 |
| Chromium | 4.36 |
| Vanadium | 3.06 |
| Tungsten | 6.31 |
| Molybdenum | 5.16 |
| Cobalt | 0.80 |

The following Table 5 is a summary of $R_c$ hardnesses of heat 9290 hardened at temperatures 2150° F. and 2175° F.

TABLE 5

| | Heat 9290 | |
|---|---|---|
| Triple Tempered at: | 2150° F.<br>$R_c$ | 2175° F.<br>$R_c$ |
| 1025° F. | 67.5 | 67.5 |
| 1040° F. | 66.5 | 66.0 |
| 1200° F.<br>(single tempered 2 hours) | 61.0 | 61.0 |

This data also shows that the hardenability is very good and is in the range of or exceeds the hardness of cobalt HSS materials.

A performance test was conducted to show how the new HSS materials compared to cobalt HSS. In this test, size one-half inch end mills made from the heat 1990 composition were compared in direct performance to M-42 end mills used on AISI 4340 material at a BHN 355 hardness level. The average number of inches cut using the new end mills was 114 while the average number of inches cut using the M42 end mills was 114.6. The results again indicate that the new end mills performed identically to regular M-42 material end mills, thus proving that cobalt is not required. Another advantage of the HSS material is that the tools experienced less chipping than the cobalt alloyed steel.

While the foregoing specific examples have been discussed in connection with HSS, it is to be understood that the invention has application to any martensitic alloy steel compositions that will benefit from the formation of intermetallic compounds and precipitates. Many modifications and variations of the invention will be apparent to those skilled in the art in view of the foregoing detailed disclosure. Therefore, it is to be understood that within the scope of the appended claims, the invention can be practiced in other ways than as specifically described.

What is claimed is:

1. A tempered martensitic alloy steel consisting essentially of about 0.15–3.5% C, 0.5–13.0% Cr, 0.05–15.0% V, 0.75–12.0% Mo, 0–15.0% W, less than 1.25% Co, each of Ni, Cu, Al, Mn and Si in a total amount of at least 4.0% with the silicon being present in an amount of 1.0% or more, and the balance essentially iron, said steel being further characterized by a microstructure containing nano-size $M_3Si$ and $M_3Al$ wherein M=Ni, Fe and/or Mn.

2. An alloy steel as claimed in claim 1 wherein Ni is present in an amount of at least 0.70%, and the Si content ranges up to about 1.6%.

3. An alloy steel as claimed in claim 1 or 2 wherein Cu is present in an amount of at least 0.40%.

4. An alloy steel as claimed in claim 1 characterized by good response to hardening and resistance to softening at high speed steel work temperatures, said steel containing 1.0–1.60% Si, 0.70–1.20% Ni, 0.60–1.0% Mn, 0.50–1.50% Al, and 0.40–1.0% Cu.

5. An alloy steel as claimed in claim 1 containing about 0.15–0.35% C, 0.60–1.00% Mn, 0.40–0.90% Cu, 7.0–10.00% Ni, 0.50–1.00% Al, 1.0–1.50% Si, 0.05–0.25% V, 0.50–1.25% Cr, and 0.75–1.25% Mo.

6. A tempered martensitic alloy steel consisting essentially of about 0.15–2.5% C, 0.5–12.5% Cr, 0.05–6.5% V, 1.5–12.0% Mo, 0–15% W, less than 1.0% Co, each of Ni, Cu, Al, Mn and Si in a total amount of at least 4.0% with the silicon exceeding 1.0%, and the balance essentially iron, said steel being further characterized by a microstructure containing nano-size $M_3Si$ and $M_3Al$ wherein M=Ni, Fe and/or Mn.

7. An alloy steel as claimed in claim 6 wherein Cu is present in an amount of at least 0.40%.

8. A martensitic die steel alloy consisting essentially of 0.30–3.5% C, 3.50–13.0% Cr, 2.75–15.0% V, 0.75–2.00% Mo, 5.75–6.75 % W, less than 1% Co, 0.70–1.20% Ni, 1.0–1.75% Si, 0.50–1.50% Al, 0.40–0.90% Cu, 0.60–1.00Mn, and the balance essentially iron.

9. A tempered martensitic armor plate alloy steel consisting essentially of 0.15–0.35% C, 0.50–1.25% Cr, 0.05–0.25% V, less than 1.0% Co, 0.75–1.25% Mo, 7.00–10.00% Ni, 1.0–1.75% Si, 0.50–1.50% Al, 0.40–0.90% Cu, 0.60–1.00% Mn, and the balance essentially iron, said steel being further characterized by a microstructure containing nano-size $M_3Si$ and $M_3Al$ wherein M=Ni, Fe and/or Mn.

10. An alloy steel as claimed in claim 1 or claim 6, wherein each of Ni, Cu, Al, Mn and Si are present in a total amount of at least 4.5%.

* * * * *